US005765540A

United States Patent [19]

Ishii et al.

[11] Patent Number: 5,765,540

[45] Date of Patent: Jun. 16, 1998

[54] METHOD OF DIAGNOSING AN EVAPORATIVE SYSTEM

[75] Inventors: Toshio Ishii; Yutaka Takaku, both of Mito; Kazuya Kawano, Hitachinaka, all of Japan

[73] Assignee: Hitachi, Ltd., Japan

[21] Appl. No.: 873,774

[22] Filed: Jun. 12, 1997

[30] Foreign Application Priority Data

Jun. 12, 1996 [JP] Japan ..... 8-150655

[51] Int. Cl.[6] ..... F02M 37/04

[52] U.S. Cl. ..... 123/520; 123/198 D

[58] Field of Search ..... 123/198 D, 520, 123/516, 518, 519, 521

[56] References Cited

U.S. PATENT DOCUMENTS 5,463,998 11/1995 Denz ..... 123/520
5,575,265 11/1996 Kurihara ..... 123/520
5,617,832 4/1997 Yamazaki ..... 123/198 D
5,635,630 6/1997 Dawson ..... 123/520
5,666,925 9/1997 Denz ..... 123/520
5,678,523 10/1997 Hashimoto ..... 123/520
5,690,076 11/1997 Hashimoto ..... 123/198 D

*Primary Examiner*—Carl S. Miller
*Attorney, Agent, or Firm*—Evenson, McKeown, Edwards & Lenahan, P.L.L.C.

[57] ABSTRACT

This invention performs a diagnosis on the evaporative system in a short period of time by pulling down the evaporative system with a negative pressure of the intake manifold of the engine and by checking a change in the internal pressure of the evaporative system being pulled down. To realize this diagnosis, when introducing a negative pressure from the intake manifold, the pulldown rate is changed based on the internal pressure of the evaporative system. Because the pulldown rate is corrected and controlled during the diagnostic process, a preliminary process for the diagnosis can be eliminated, shortening the time required for the diagnosis. Further, this method allows the evaporative system to be diagnosed without being influenced by external factors such as atmospheric pressure, the internal volume of the evaporative system, the amount of evaporative gas generated, or presence or absence of leakage.

12 Claims, 16 Drawing Sheets

METHOD OF DIAGNOSING AN EVAPORATIVE SYSTEM

BACKGROUND OF THE INVENTION

The present invention relates to a pulldown process used to diagnose a fault in an evaporative system. In the evaporative system, an evaporative gas (evaporated fuel) generated in a fuel tank is temporarily absorbed to an absorber in a canister and then released (or purged) under a predetermined operating condition into an intake system of the internal combustion engine for combustion. This diagnosing system concerns particularly the pulldown process for introducing a negative pressure from the intake manifold.

To prevent the evaporative gas from being released into an open air, the evaporative system is hermetically sealed. If for some reason the evaporative gas pipe is damaged or disconnected, however, the evaporative gas in the canister will be released outside. The clogging of a purge passage will also lead to a similar trouble. It is therefore necessary to diagnose whether there are any such faulty conditions in the evaporative system.

Japanese Patent Laid-Open No. 193518/1994 describes a technique, in which an intake manifold negative pressure is applied through a purge valve to a purge system and a pressure change in the purge system is detected by a pressure sensor to determine when the purge system fails. Japanese Patent Laid-Open No. 166974/1995 discloses a technique, in which in the event of an anomaly in a fuel evaporation prevention mechanism, a purge control valve is controlled by an electronic control circuit, according to the pressure in the intake manifold as detected by a pressure sensor installed in the intake manifold and to the amount of fuel in the fuel tank as measured by a fuel gauge, to properly change the rate at which the negative pressure is introduced from the intake manifold. This arrangement allows the pressure in the hermetically closed system to be regulated without being influenced by the pressure in the intake manifold or by the amount of fuel in the fuel tank. Japanese Patent Laid-Open No. 193520/1994 describes that when the evaporative fuel flow rate exceeds a predetermined value, the opening of a purge solenoid valve is increased to prevent the evaporative fuel from overflowing the canister to an open air.

Further, Japanese Patent Laid-Open No. 249095/1994 discloses a diagnosing technique using a tank pressure sensor. In this technique, a duty ratio of a tank vent valve control is determined according to a fuel tank level measured. The vent valve is opened according to the duty ratio thus determined and the shutoff valve is closed. Then a leakage diagnosis is made based on a negative pressure reduction gradient, the rate at which the negative pressure is reduced in the tank. The specification also describes a technique, in which the vent valve is opened according to a predetermined duty ratio and, during diagnosis, is opened according to a duty ratio that is determined according to a negative pressure increase gradient at which the negative pressure in the tank increases. In either case, the duty ratio is determined beforehand and the vent valve is controlled according to the duty ratio thus determined.

In the evaporative system diagnosis discussed above, it is already known that the purge system is diagnosed based on a change in a negative pressure introduced in the evaporative system. It is also a known technique to determine a duty ratio of the purge control valve according to the amount of fuel in the fuel tank and then introduce a negative pressure through the purge control valve, or alternatively to introduce a negative pressure temporarily and then determine the duty ratio of the purge control valve according to a negative pressure increase gradient, followed by introduction of a negative pressure through the valve. These methods, however, require a preliminary step to determine a duty ratio for introducing a negative pressure, giving rise to a problem of virtually prolonging the diagnosing time. In the method of determining the duty ratio for diagnosis from the gradient of the temporarily introduced negative pressure, a step for such an operation must be added to the actual diagnosing process, which necessarily prolongs the actual diagnosing time. In the latter method in particular, if there is any leakage when a negative pressure is introduced temporarily, the duty ratio determined from the negative pressure increase gradient will not be suitable for the diagnosis.

It is an object of this invention to provide a negative pressure introduction that can deal with these situations, i.e., to provide a diagnosing method that improves the pulldown and thereby allows diagnosis to be performed on the evaporative system in as short a time as possible.

SUMMARY OF THE INVENTION

The present invention provides a negative pressure introduction process in the evaporative system diagnosis, i.e., a diagnosing method that controls the pulldown step for diagnosis to allow diagnosis to be made in a short period of time.

In more concrete terms, in the evaporative system in which an evaporative gas generated in the fuel tank is temporarily absorbed into an absorber and then released into the intake manifold of the engine, the method of diagnosing the evaporative system according to its pressure (including pressure changes) includes a pulldown process to introduce a negative pressure from the intake manifold of the engine and is characterized in that the pulldown rate in the pulldown process is changed according to the internal pressure or pressure change in the evaporative system.

This invention is characterized in that the pulldown rate is changed according to a deviation from a target pressure, a deviation from a reference pressure given by a pulldown rate pattern, and a deviation from an amount or rate of change of the actual pressure in the evaporative system during the pulldown process. That is, the evaporative system is actually pulled down and then the rate of pulldown is modified and controlled according to the condition in the evaporative system, i.e., pressure or pressure change. It is thus possible to eliminate the preliminary step described above and to reduce the time it takes to reach the final target pressure of the pulldown. This in turn shortens the length of time required by the diagnosis.

Another feature of this invention is that a limit is imposed on the time taken by the pulldown. This makes it possible to virtually back up the diagnosing system and thereby prevent a useless pulldown from being continued.

During a predetermined time after the initiation of pulldown or before the end of the pulldown, the pulldown is performed more moderately than in other parts of the process. This alleviates the effects of the pulldown on other systems.

DETAILED DESCRIPTION OF THE EMBODIMENT

Figure 1:
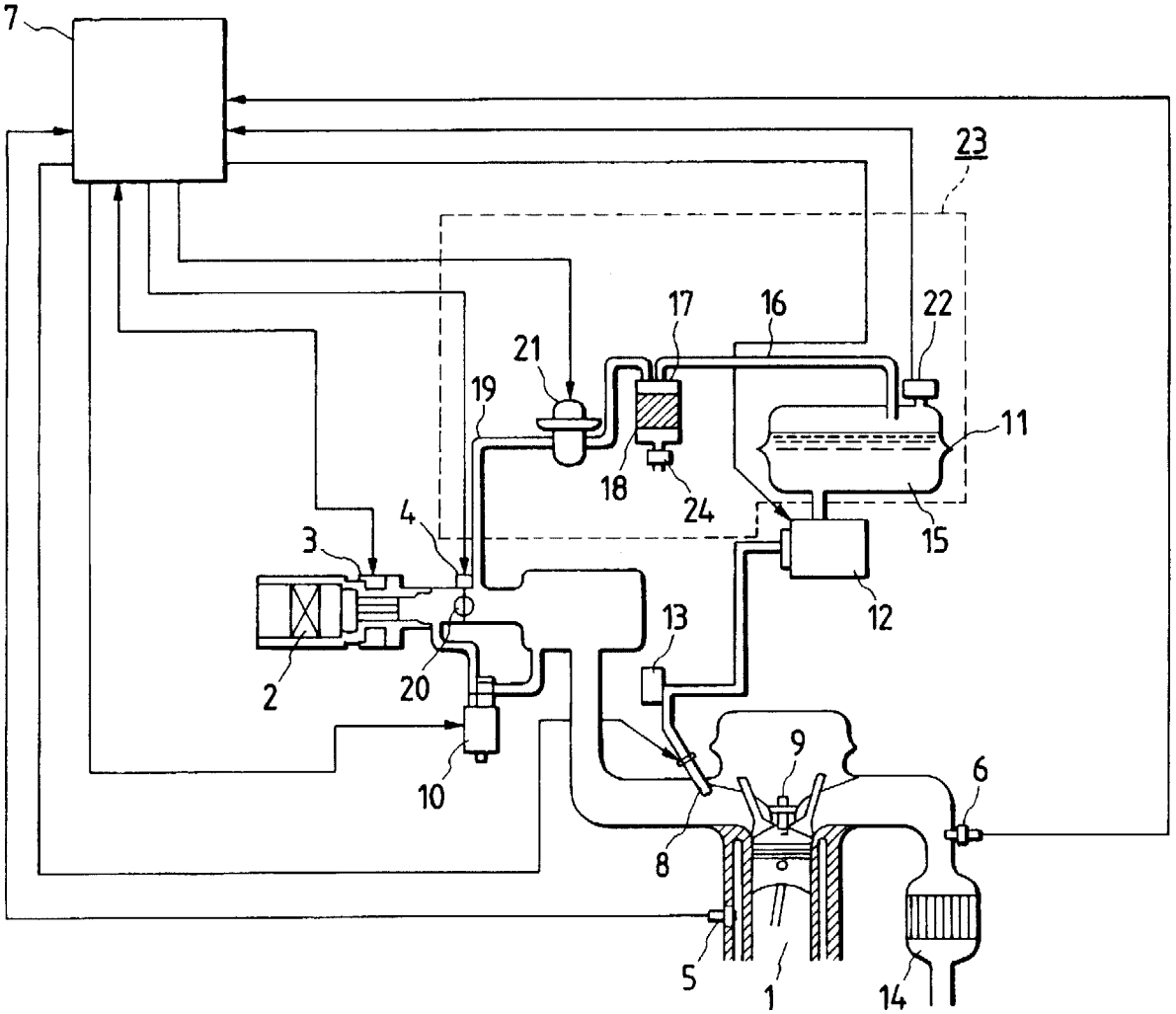
FIG. 1 is one embodiment that realizes the present invention.

One embodiment of a system that realizes the present invention will be described by referring to FIG. 1.

An engine body 1 has an air cleaner 2, an air flow sensor 3, a throttle position sensor 4, a water temperature sensor 5 and an air-fuel ratio sensor 6. Detected values from these sensors are sent to an engine control unit 7 that calculates an amount of fuel to be injected, an ignition control value, and an idle speed control (ISC) value. The amount of fuel to be injected is converted into a fuel injection pulse width that activates an injector 8 to inject the desired amount of fuel, and the ignition control output fires the fuel with an ignition plug 9 at an optimum timing. The idle speed control value is output to an ISC control valve 10 that supplies an optimum amount of auxiliary air. The engine body also includes a fuel pump 12 to pressurize and supply the fuel from a fuel tank 11 to the injector 8, and a fuel pressure regulate valve 13 to regulate the pressure of the pressurized fuel.

The fuel injected from the injector 8 is mixed with intake air to form an air-fuel mixture, which then flows into the cylinder where it is compressed by a piston and fired, with an exhaust gas from the fuel combustion discharged into an exhaust pipe. Oxidation and reduction of the exhaust gas is promoted by a catalyst 14 installed in the exhaust pipe to remove noxious components-hydrocarbon, carbon monoxide and nitrogen oxides-from the exhaust gas. To maximize the cleaning effect of the catalyst 14, the system of this invention has an air-fuel ratio feedback system (controlled by the engine control unit 7) that feedback-controls, according to the output of the air-fuel ratio sensor 6, the air-fuel mixture ratio in terms of rich and lean values, alternately in the vicinity of the theoretical air-fuel ratio.

An evaporative gas produced from the fuel tank 11 containing a fuel 15 is absorbed into an absorber 18 in a canister 17 through an evaporative gas pipe 16. The absorbed fuel is purged through a release pipe 19 into a region downstream of a throttle valve 20 of the engine for combustion in the cylinder. The release pipe 19 has a purge valve 21 that controls the timing and amount of purge. The purge valve 21 may, for example, be an electrically controlled duty valve that controls the equivalent opening area.

A pressure sensor 22 measures the pressure of the evaporative system 23. A drain valve 24 is installed at a fresh air introducing port (drain) of the canister 17 to control the amount of fresh air introduced from the drain. The engine control unit 7 controls the purge valve 21 and the drain valve 24 and measures and processes the pressure of the evaporative system 23 to detect a failure (leakage) in which the fuel leaks out into open air from the evaporative system 23.

The effect that the position of the pressure sensor 22 has on the diagnostic will be explained by referring to FIGS. 2 and 3.

Figure 2:
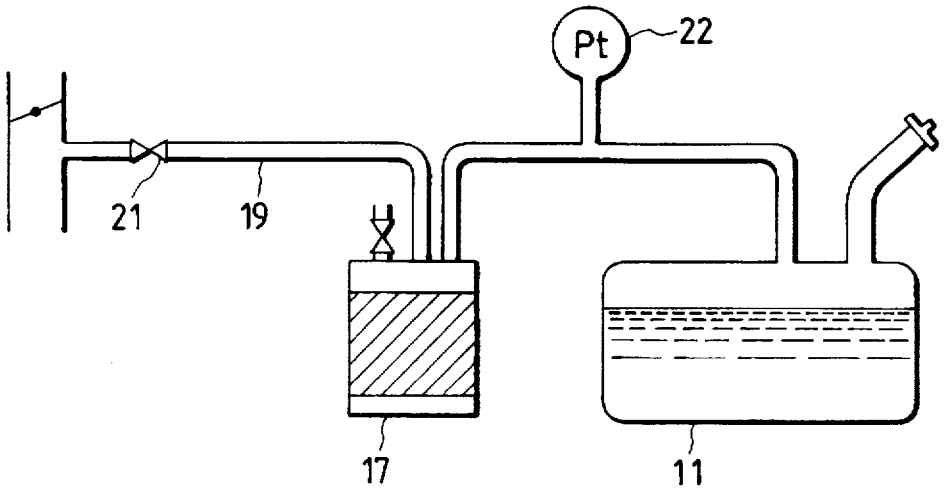
FIG. 2 is an example configuration of the evaporative system.

FIG. 2 shows an example system having the pressure sensor 22 installed between the canister 17 and the fuel tank 11. In this system, some discrepancy arises between the pressure in the fuel tank 11 and the pressure at the installation position of the pressure sensor 22 because of the influences of pressure losses and flow in a pipe between the fuel tank 11 and the pressure sensor 22. Thus, a diagnosing method considering this pressure deviation needs to be developed.

Figure 3:
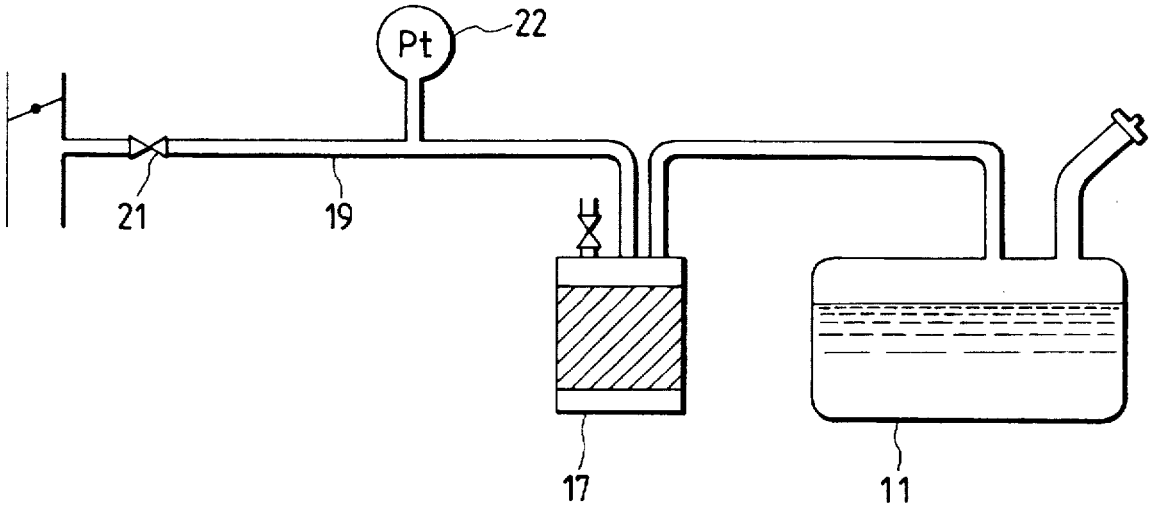
FIG. 3 is another configuration of the evaporative system.

FIG. 3 shows a system in which the pressure sensor 22 is installed between the canister 17 and the purge valve 21. This system has a problem that the effects of piping, such as pressure losses, are greater than those in the system of FIG. 2.

The arrangement of the pressure sensor 22 as shown in FIG. 3, however, has an advantage that if the pipe between the canister 17 and the fuel tank 11 is clogged when a negative pressure is introduced into the evaporative system, the purge valve 21 can be controlled properly according to the output of the pressure sensor 22 to prevent an excess negative pressure from being applied to the canister 17. Thus, when the canister 17 has no sufficient pressure withstandability, the location of the pressure sensor 22 shown in FIG. 3 is the appropriate installation position.

When the pressure sensor 22 is directly attached to the fuel tank 11, though not shown, the influences of pressure losses and flow in the pipe are minimized, making it possible to measure the pressure of the evaporative system 23 more correctly than when the pressure sensor 22 is installed as shown in FIG. 2.

As described above, these pressure sensor installation positions have their own advantages and disadvantages. Hence, it is desired that the installation location of the pressure sensor 22 be chosen according to the purpose of its use and that, when the sensor installation position is limited because of engine mounting conditions, the merits and demerits of the installation positions be thoroughly checked to determine the appropriate position that meets desired control constants and other requirements.

Figure 4:
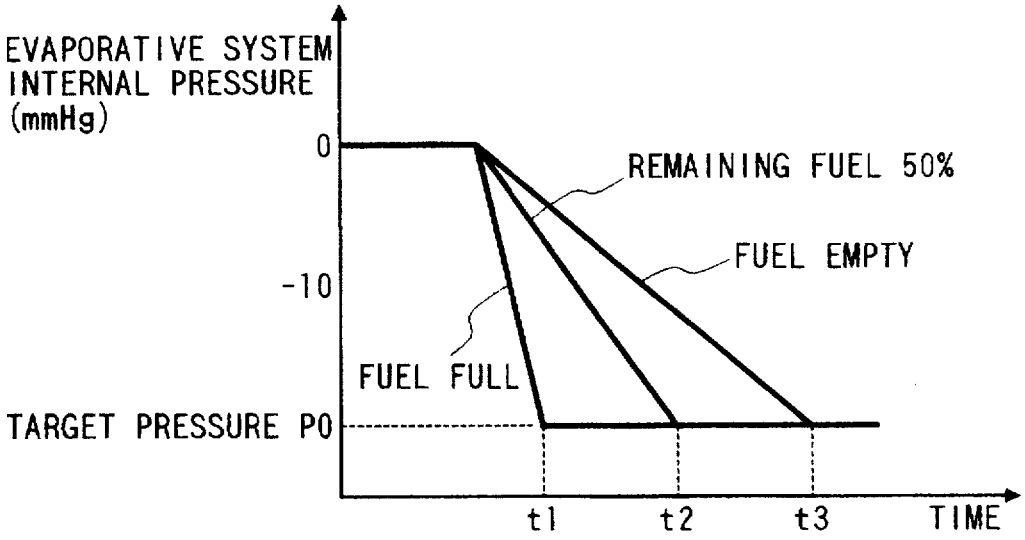
FIG. 4 is a diagram showing an example effect the amount of remaining fuel has on the pulldown time.
Figure 5:
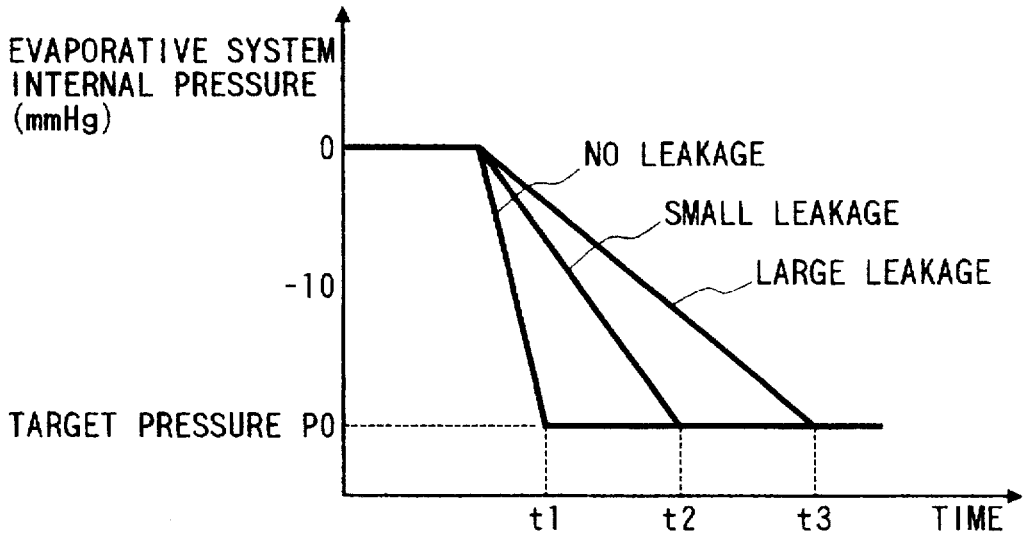
FIG. 5 is a diagram showing an example effect the amount of leakage has on the pulldown time.
Figure 6:
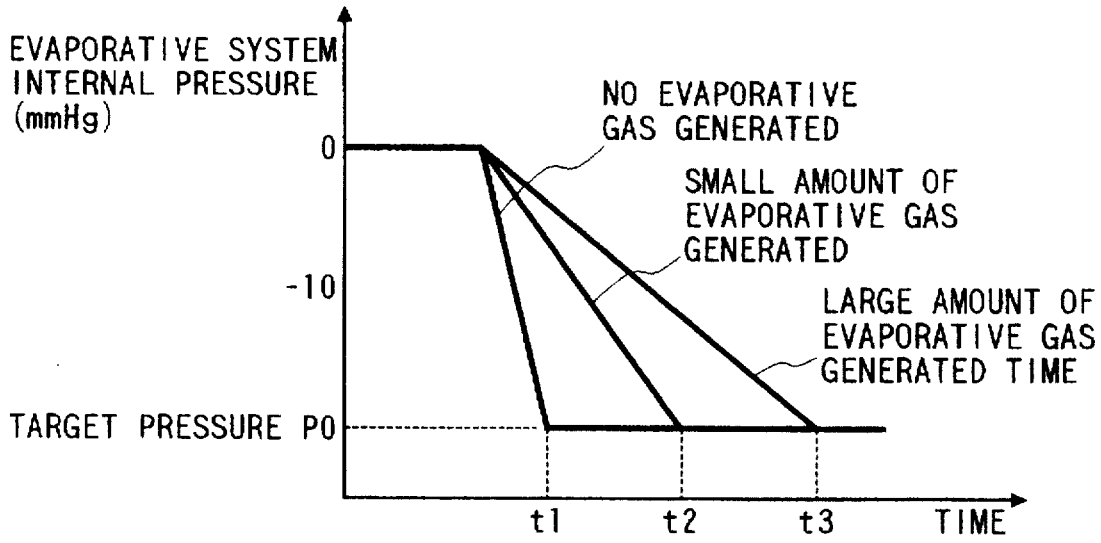
FIG. 6 is a diagram showing an example effect the amount of evaporative gas generated has on the pulldown time.

FIGS. 4 to 6 are diagrams showing how the rate of pressure reduction during the process of pulldown—a phenomenon in which the pressure in the evaporative system 23 is rapidly reduced by the negative pressure in the intake manifold when the purge valve 21 is opened, after the evaporative system 23 including the fuel tank 11 was made a closed space by closing the purge valve 21 and the drain valve 24 of FIG. 1—is influenced by the amount of fuel remaining in the tank at time of evaporative system diagnosis, the presence or absence of leakage from the evaporative system 23 and the amount of leakage, and also the amount of evaporative gas generated. FIG. 4 illustrates that the smaller the amount of fuel remaining in the tank at time of evaporative system diagnosis, i.e., the greater the empty volume in the tank, the greater the time it takes to pull down the internal pressure of the evaporative system to the target pressure P0. FIG. 5 shows that the greater the leakage from the evaporative system 23, the longer it takes to pull down the internal pressure of the evaporative system to the target pressure P0. FIG. 6 shows that the larger the amount of evaporative gas generated, the longer it takes to pull down the internal pressure of the evaporative system to the target pressure P0. It is therefore understood that the pulldown time difference is large between a condition in which there are factors requiring the maximum amount of pulldown time and a condition in which there are factors requiring the minimum amount of pulldown time and that applying a single purge valve opening (pulldown rate) to all conditions will result in the diagnosing time varying greatly from one condition to another. It is therefore necessary to regulate the pulldown rate properly according to the actual condition. For example, it is an effective method to directly detect the internal pressure of the evaporative system during the pulldown and regulate the pulldown rate according to the pressure condition.

When, for example, the operation is continued at high temperatures that cause a large mount of evaporative gas, with a small amount of fuel remaining in the tank and with a leakage occurring in the evaporative system 23, a long pulldown time is required. This means that when the above operating condition persists, the evaporative system diagnosing process cannot be finished even after an ordinary diagnosing time has elapsed, giving rise to a possibility that a serious failure (leakage) in the evaporative system may be left uncorrected for an extended period of time. With the failure left uncorrected, a large amount of evaporative gas (unburned fuel) is emitted, polluting the air.

Figure 7:
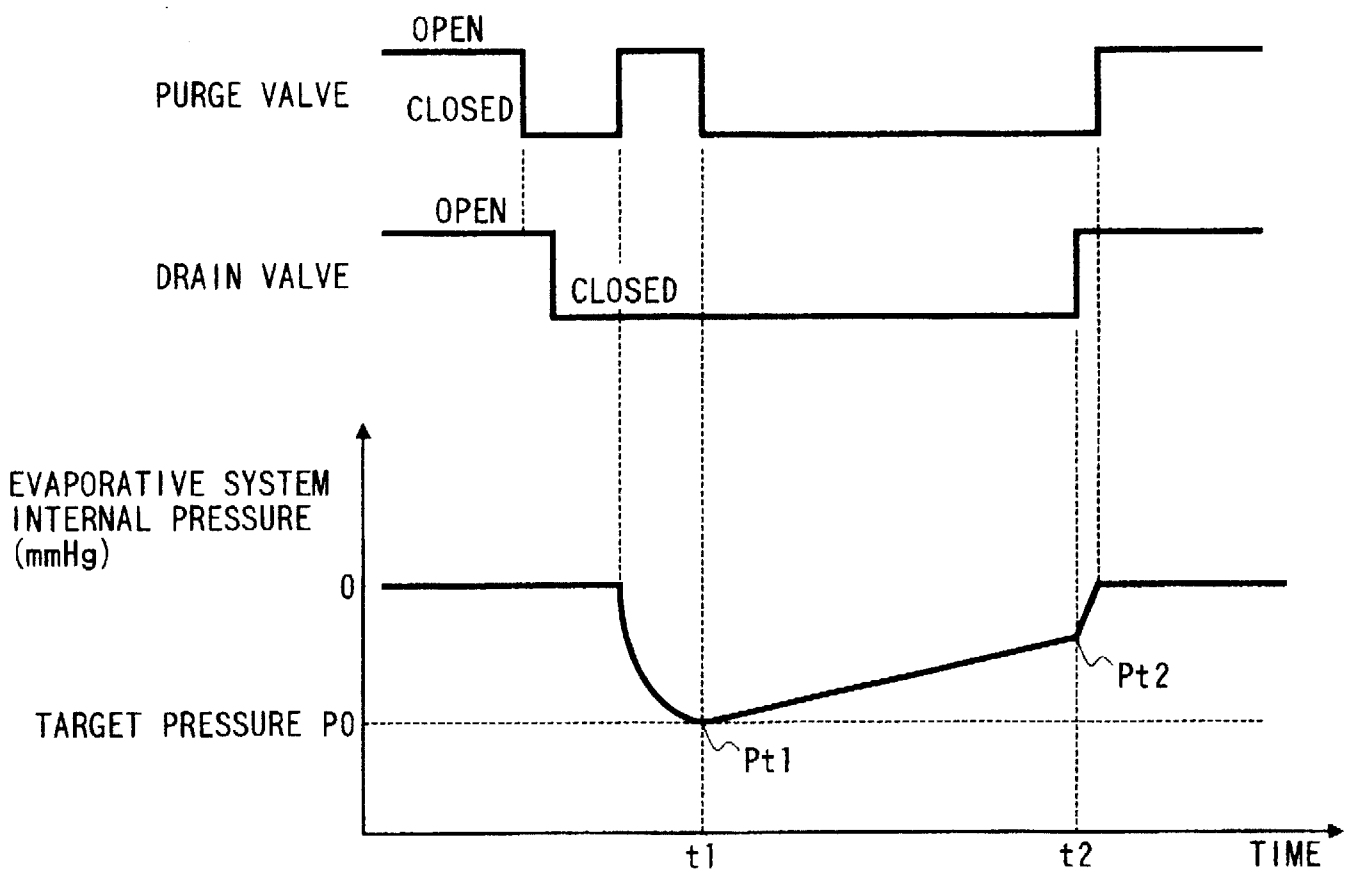
FIG. 7 is a diagram showing the operation timings of valves.

FIG. 7 shows the operation timings of valves and pressure changes in the evaporative system, used for diagnosing the evaporative system. Normally the drain valve 24 is open. The evaporative gas generated in the fuel tank 11 is absorbed by the absorber 18 in the canister 17. When the purge valve 21 is opened according to the engine operating condition, the negative pressure in the intake manifold causes the absorbed evaporative gas to be desorbed from the absorber 18 and carried into the intake manifold, along with the air flowing in from the open air through the open drain valve 24, for combustion in the engine. In this way, the fuel vapor generated in the fuel tank 11 is prevented from being released into the open air.

In making a diagnosis of the evaporative system 23, first the purge valve 21 is closed temporarily and the drain valve 24 is also closed. In this condition, the evaporative system 23 including the fuel tank 11 becomes a closed space. Next, when the purge valve 21 is opened, the negative pressure in the intake manifold quickly pulls down or reduces the pressure in the evaporative system 23. The internal pressure of the evaporative system is measured by the pressure sensor 22 as a pressure difference Pt from an atmospheric pressure Pa. When the pressure difference Pt is lower than the target pressure P0 (set at around −20 to −30 mmHg) or when the difference between Pt and P0 falls in a predetermined range, the purge valve 21 is closed and the pressure difference Pt1 is measured. Now, the evaporative system is sealed, so that if there is no leakage, the internal pressure of the evaporative system remains constant. If, however, there is any leakage in the evaporative system, the internal pressure in the evaporative system gradually approaches the atmospheric pressure according to the magnitude of the leakage. After a specified time, from t1 to t2 in FIG. 7, has elapsed or after the pressure change has become greater than a predetermined value (either when the amount of change from Pt1 reaches a predetermined value or when Pt itself reaches a predetermined value other than Pt1), the pressure difference Pt2 is measured. Then, the drain valve 24 is opened, followed by the opening of the purge valve 21 (returning to the normal control state). The above process is controlled by the engine control unit 7, which decides whether there is any leakage in the evaporative system 23, based on the measurements of pressure differences Pt1, Pt2.

The errors of the pressure sensor 22 can be corrected as follows. In the initial part of the above process, when a predetermined time elapses after the closure of the purge valve 21, the atmospheric pressure is applied through the drain valve 24 to the pressure sensor 22. At this time, a deviation of the output of the pressure sensor 22 from the atmospheric pressure (in the case of pressure sensor 22, a deviation from 0) is measured. After this, the measured value of the internal pressure of the evaporative system is corrected to compensate for the pressure sensor error.

Figure 8:
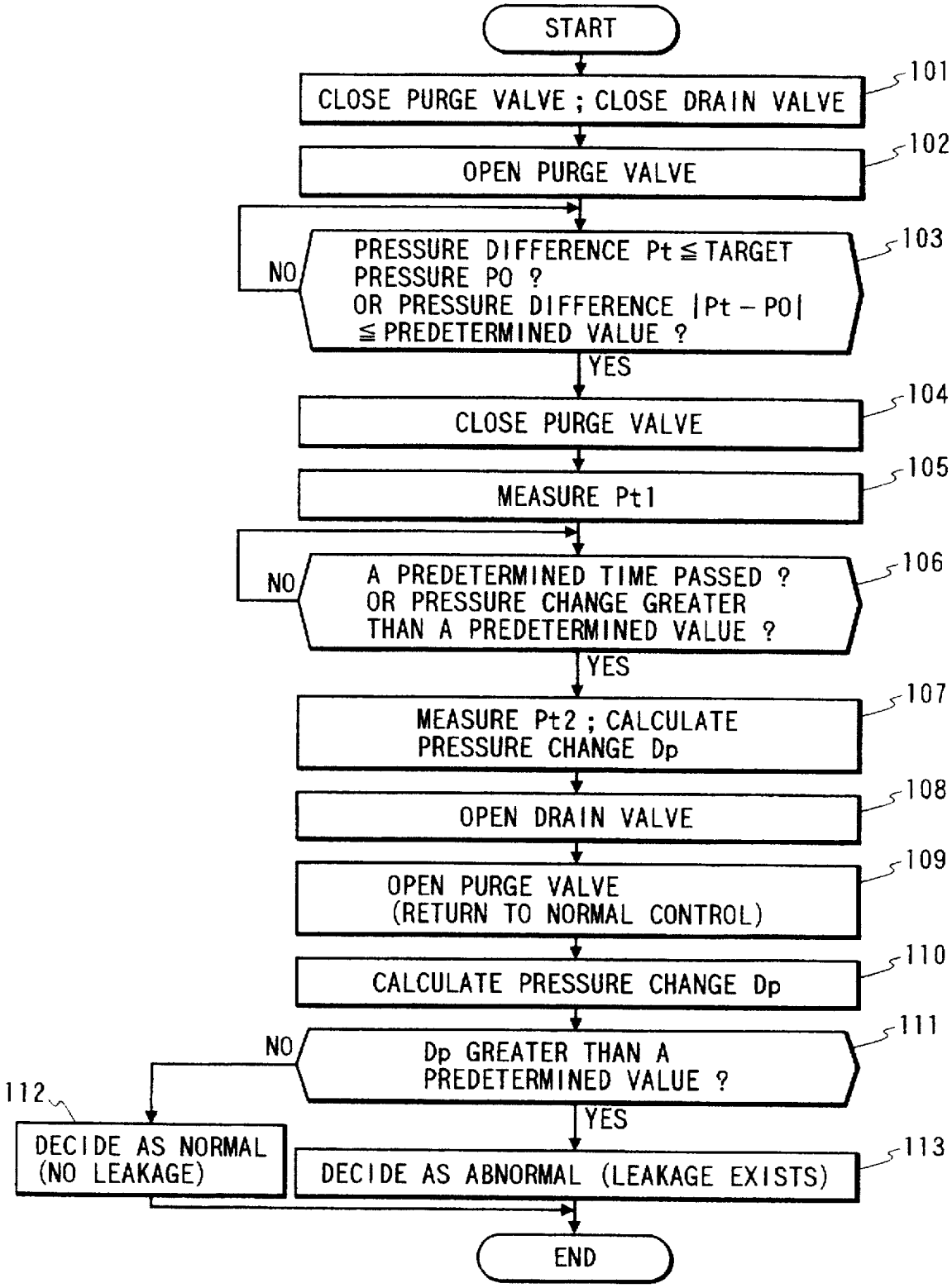
FIG. 8 is an example flow chart of the process.

FIG. 8 is a flow chart showing operation steps executed by the engine control unit 7 in performing diagnosis. At step 101, the purge valve 21 is closed and then the drain valve 24 is closed to make the evaporative system 23 a closed space. At step 102 the purge valve 21 is opened. The gas in the evaporative system is drawn into the negative pressure intake manifold, rapidly reducing the pressure in the evaporative system. Step 103 checks if the pressure difference Pt between the internal pressure of the evaporative system and the atmospheric pressure Pa is lower than the target pressure P0 or if the difference (absolute value) between Pt and P0 is lower than a predetermined value. If so, the purge valve 21 is closed at step 104 and Pt1 is measured at step 105. When a predetermined time elapses or when the change in the evaporative system internal pressure is larger than a specified value, step 107 measures Pt2. With the above process complete, the measurements required for determining the leakage are all taken. To return the evaporative system 23 to the normal state, step 108 opens the drain valve 24 and step 109 opens the purge valve 21 (returning to the normal control state). Using the above measurements Pt1, Pt2, step 110 calculates a pressure change Dp=(Pt2−Pt1)/(time spent) for use with the leakage detection.

If the pressure change Dp is greater than a specified value (leakage detection threshold), step 111 decides that the evaporative system is abnormal. This is followed by various processing, such as issuing an alarm to the driver, storing in memory the operating conditions that existed when a fault code or failure was detected, and executing a failsafe operation according to a predetermined process. When the pressure change Dp is smaller than the predetermined value, step 113 decides that the evaporative system is normal and performs the corresponding processing.

Figure 9:
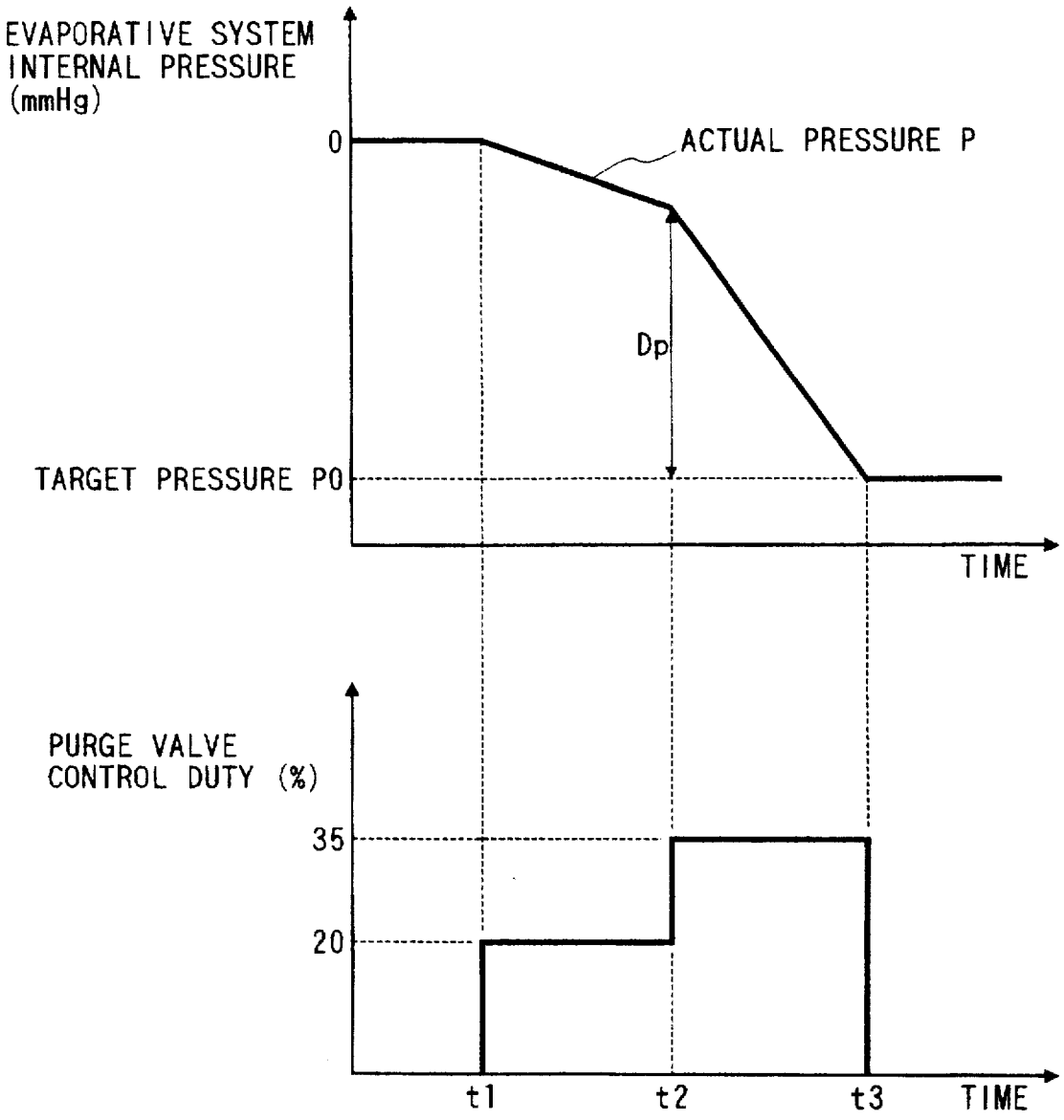
FIG. 9 is a diagram showing an example pulldown process.
Figure 10:
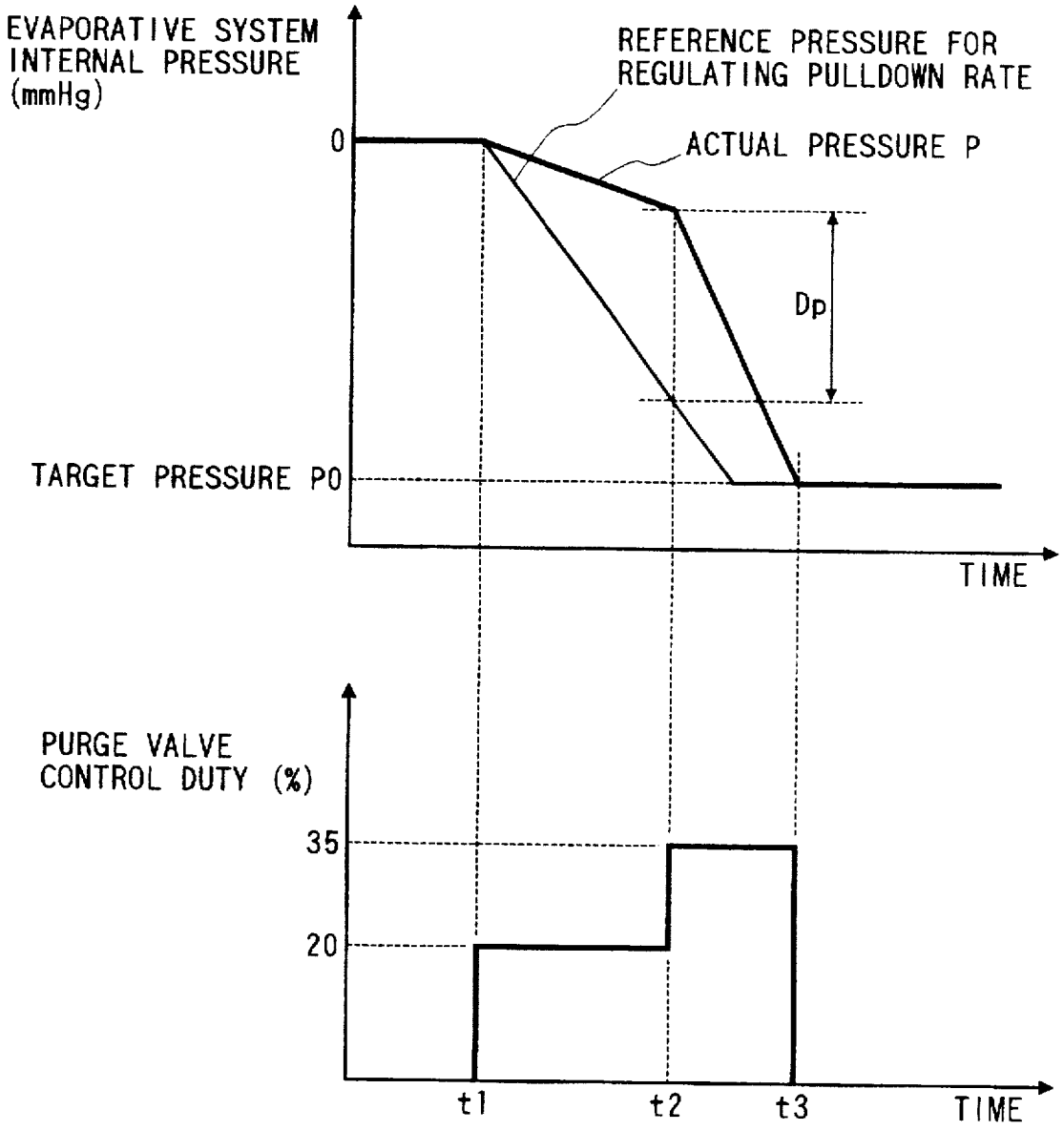
FIG. 10 is a diagram showing another pulldown process using a pulldown reference pressure.
Figure 11:
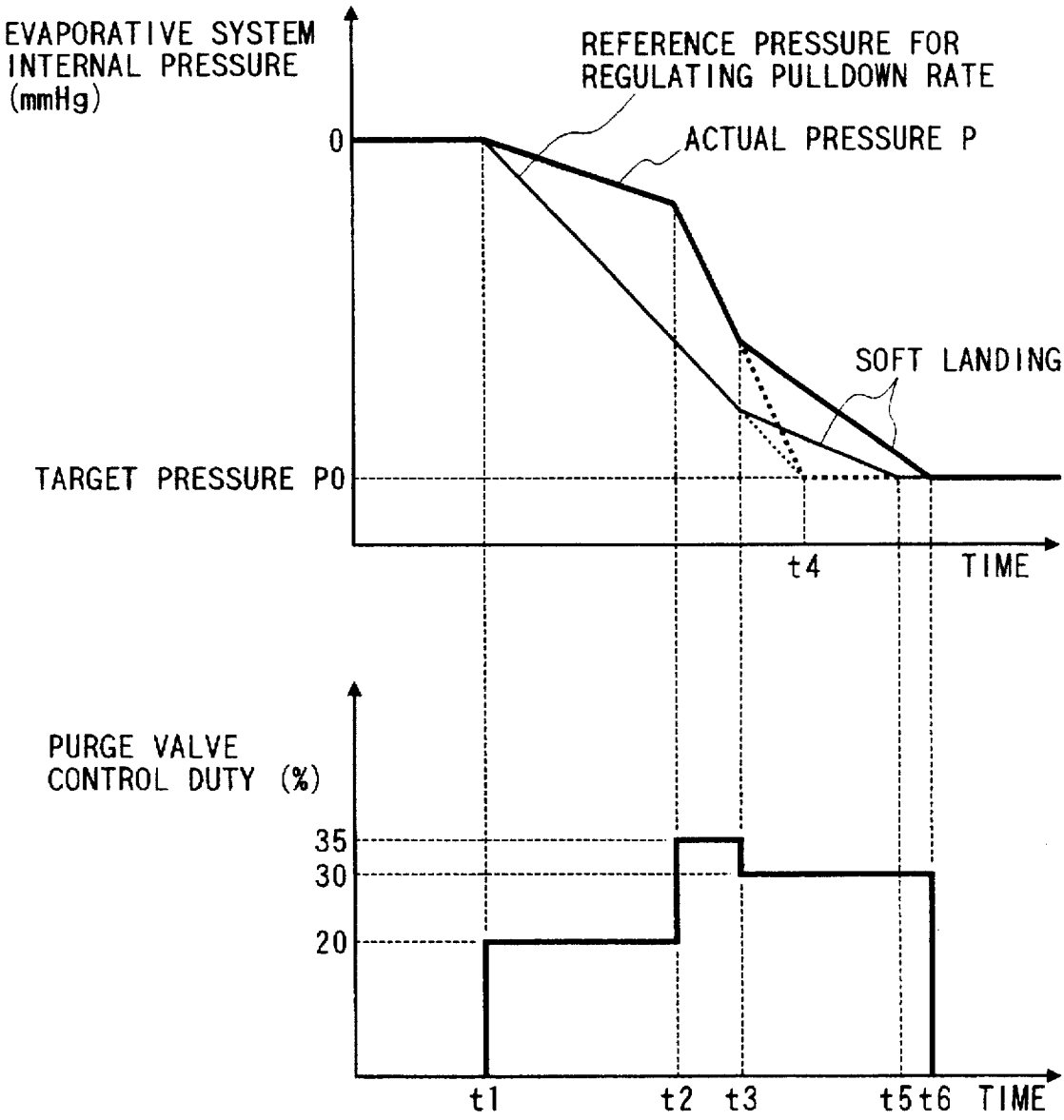
FIG. 11 is a diagram showing an example of soft landing in the pulldown process.

By referring to FIGS. 9 to 11, we will explain about the method of changing the pulldown rate according to the detected difference between the actual internal pressure of the evaporative system being pulled down and the pulldown target pressure P0. Because the pulldown time varies greatly according to the factors explained in FIGS. 4 to 6, a long diagnosing time may be required depending on the operating condition and evaporative system state. When such a condition lasts for an extended period of time, there is a possibility, as discussed above, of a serious trouble with the evaporative system left uncorrected because a diagnosis cannot be executed. An example method, which deals with this situation by directly detecting a change in the internal pressure of the evaporative system being pulled down and properly regulating the pulldown rate based on the detected pressure change, will be explained below.

The pulldown rate is regulated by changing the opening area of the purge valve 21.

At time t1 in FIG. 9 the pulldown is initiated with the purge valve set at the predetermined opening. At time t2 a predetermined period after the time t1, the pressure difference Dp between the internal pressure of the evaporative system and the target pressure P0 is determined. When the pressure difference Dp is greater than the predetermined value, it is decided that the pulldown rate should be increased and the engine control unit 7 changes the control duty of the purge valve 21, for instance, from 20% to 35% according to the pressure difference Dp to increase the pulldown rate. In this way, the internal pressure of the evaporative system can be quickly changed to the target pressure P0. To prevent the diagnostic operation from being executed under conditions not suited for pulldown, including the condition where the amount of evaporative gas generated is very large, the pulldown operation is stopped when the pulldown time reaches a predetermined time.

An alternative method to FIG. 9 will be explained by referring to FIG. 10. This method has a reference pressure to be compared with the actual pressure in the evaporative system to regulate the pulldown rate. When the difference Dp between these pressures is large, the purge valve opening is regulated to increase the pulldown rate.

FIG. 11 is a diagram showing the process of soft landing whereby the pulldown rate is reduced when the pulldown rate that was increased according to the difference Dp between the actual pressure in the evaporative system and the reference pressure for pulldown rate regulation comes close to a target pressure P0 in FIG. 10.

When the pressure sensor 22 is arranged between the canister 17 and the purge valve 21 in FIG. 3, a large pressure difference is produced, as described earlier, between the pressure in the fuel tank 11 and the pressure at the installation position of the pressure sensor 22 due to influences of pressure losses and flow in the canister 17 and in the piping between the canister 17 and the purge valve 21 and between the fuel tank 11 and the pressure sensor 22. This is because if the evaporative system is hermetically closed in a negative pressure by closing the purge valve 21 after the evaporative system's internal pressure has reached the target pressure P0, the negative pressure at the pressure sensor 22 installation position instantaneously shoots up to the positive pressure side due to the influences of pressure losses and flow in the piping immediately after the purge valve 21 is closed. This sudden rise in the evaporative system's internal pressure constitutes a large external disturbance for the diagnosing operation that, as explained in FIGS. 7 and 8, utilizes a pressure change when the evaporative system is hermetically closed in a negative pressure. To cope with this problem, the pulldown rate is reduced slightly before the internal pressure of the evaporative system being pulled down reaches the target pressure P0, to provide a waiting time for the influences of pressure losses and flow in the piping to become small, thereby preventing the negative pressure at the pressure sensor 22 installation position immediately after the closure of the purge valve from jumping to the positive pressure side even in the case where the pressure sensor 22 is installed between the canister 17 and the purge valve 21. This method of reducing the pulldown rate is the soft landing shown in FIG. 11.

FIG. 11 shows an example case where the soft landing data is set to the pulldown rate regulation reference pressure. The soft landing is effective for the pulldown operation of FIG. 9 and also for the one to be explained in FIG. 12.

Figure 12:
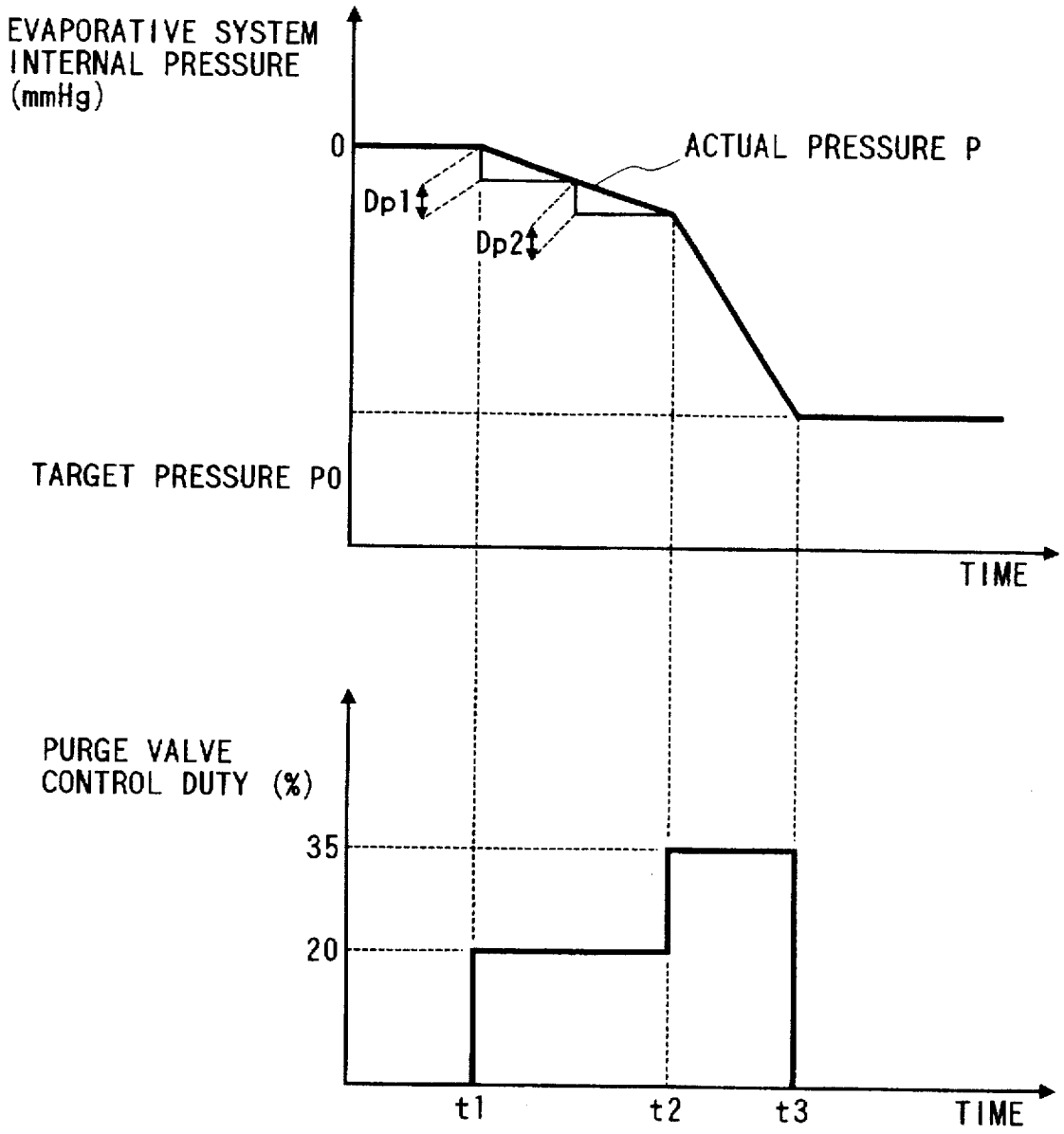
FIG. 12 is a diagram showing another example of the pulldown process.

FIG. 12 shows a method of changing the pulldown rate by detecting an amount or rate of change of the actual pressure in the evaporative system being pulled down and then regulating the purge valve opening according to the magnitude of the rate of change. After the pulldown is started (time t1), the engine control unit 7 detects the speed of diagnosis process program or the amount of change in the pressure of the evaporative system at predetermined intervals and regulates the pulldown rate according to the result of one or more detections (time t2). For example, the amount of pressure change detected by a single measurement or the average of pressure changes detected by several measurements is compared with a predetermined reference value. When the detected value is smaller than the predetermined reference value, the purge valve opening is controlled according to the pressure difference to regulate the pulldown rate.

Figure 13A:
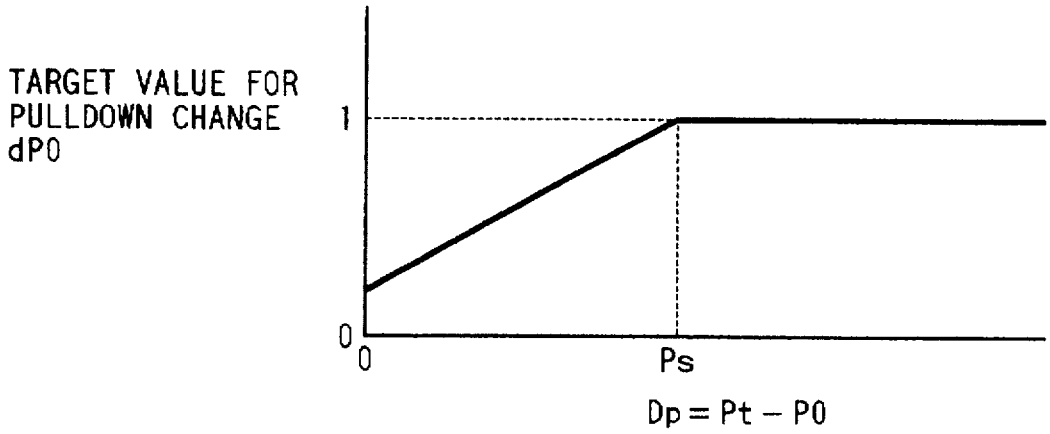
FIG. 13 is a diagram showing a method of realizing the soft landing.
Figure 13B:
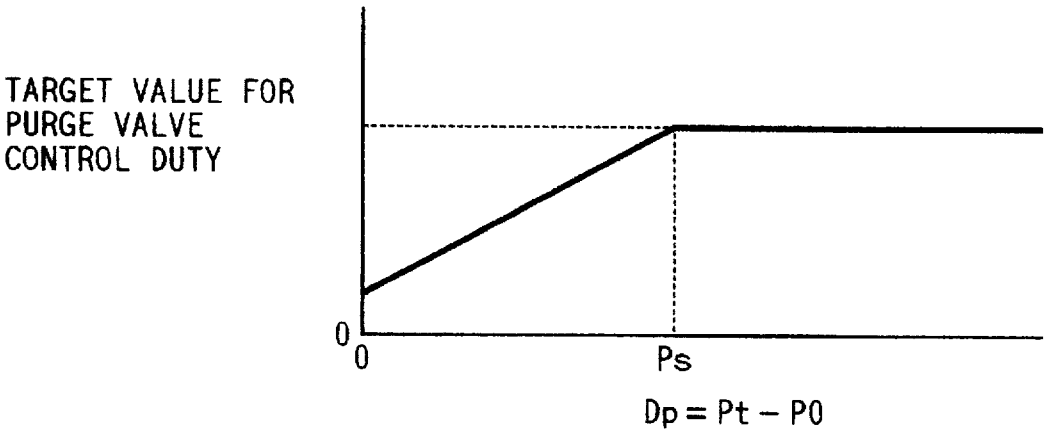
Figure 14:
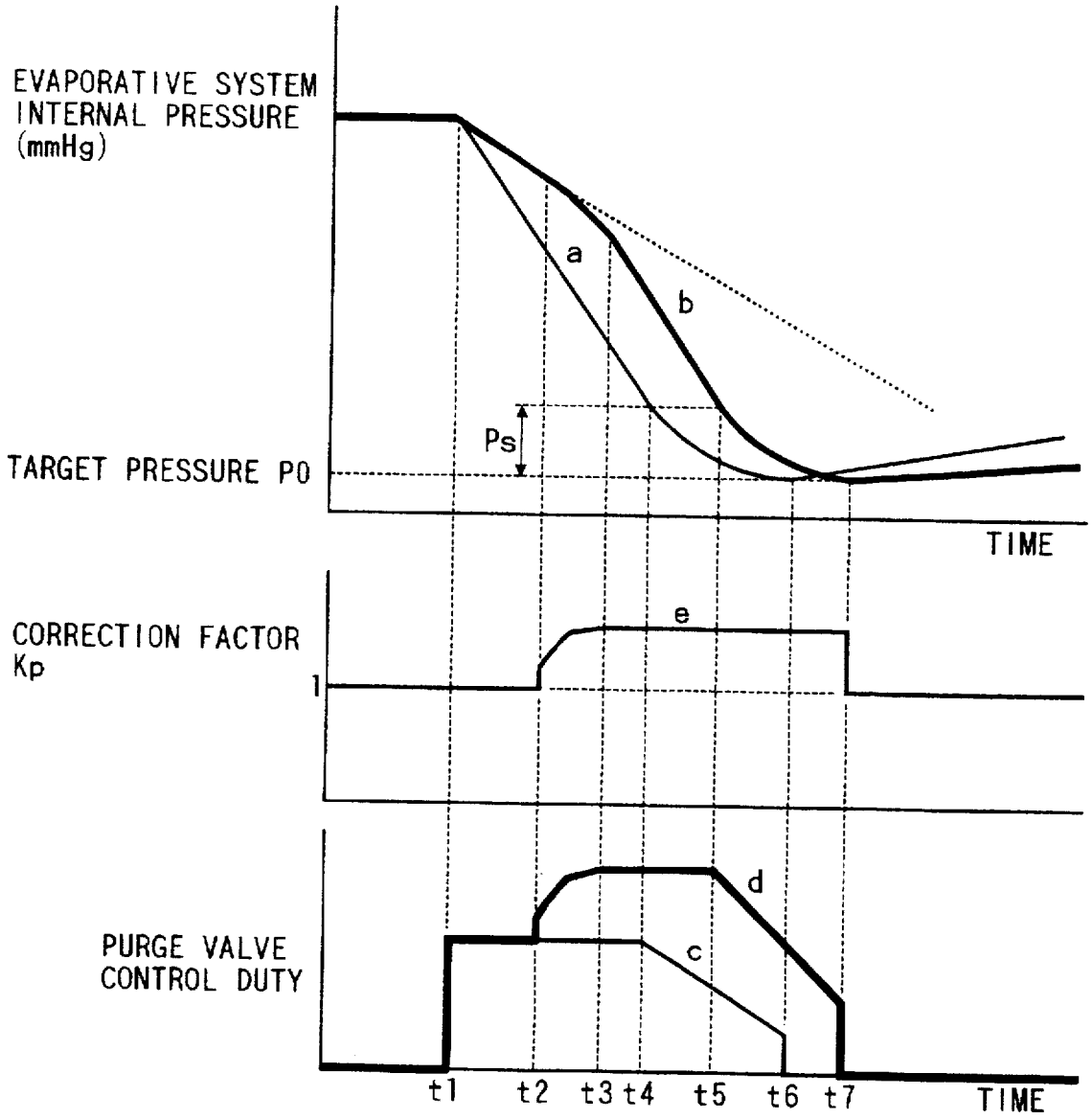
FIG. 14 is a diagram showing the soft landing control and a change in the internal pressure of the evaporative system.

Next, a method of regulating the pulldown rate according both to the difference Dp between the actual internal pressure Pt of the evaporative system being pulled down and the target pulldown pressure P0 and to the amount of change of Pt (the direction of increasing negative pressure is taken as positive) will be explained by referring to FIG. 13. FIG. 13(*a*) shows the relation between the pressure difference Dp (between the evaporative system's internal pressure Pt and the target pulldown pressure PO) and the target value of the pulldown change dPO. FIG. 13(*b*) shows the relation between the pressure difference Dp and the target value of the purge valve control duty cpcdy0. This example has a small setting of Dp, i.e., the control duty of the purge valve is made small as the pulldown nears its end so as to close the purge valve slowly. The purge valve control duty and the change in evaporative system's internal pressure when the control is made by using these values will be described by referring to FIG. 14. The change in the evaporative system's internal pressure when the pulldown proceeds along the target value of pulldown change dPO of FIG. 13(*a*) is represented by a curve a. The purge valve control duty at this time assumes the target value and is represented by a curve c. After time t4 when the pressure difference Dp equals Ps, the purge valve control duty gradually decreases and at the same time the amount of change of Pt also decreases. Here let us explain about a case where the amount of change during pulldown is smaller than the target value, as indicated by a curve b. At time t1 the purge valve is opened to start the pulldown. To protect against noise-like variations of the evaporative system internal pressure Pt that occur immediately after the purge valve is opened, the purge valve control duty is set to the target value cpcdy0. After time t2, Pt is measured at predetermined intervals, for example, every 1 second and the amount of change dP of Pt is calculated. Using Dp and the target value of change dPO determined from the difference Dp according to the relation of FIG. 13(*b*), a correction factor Kp is calculated as follows.

$$KP_n = KP_{n-1} + (dP_n - dpO_n) * k$$

where a subscript n indicates that the value is a current one and n−1 indicates that the value is a previous one; and k is a predetermined coefficient. The actual control duty is changed to a value equal to Kp times the target value of the purge valve control duty cpcdy0. In this way, as shown by the curves e and d, the correction factor Kp and the control duty gradually increase during the period from time t2 to time t3. Because the actual change dP and the target value of change dPO become equal at time t3, the correction factor does not change thereafter. After time t5 when the difference Dp equals Ps, the target value of the purge valve control duty decreases progressively, causing the purge valve control duty to decrease until at time t7 the target pressure PO is reached. Because the pulldown is finished, the correction factor Kp is returned to the initial value of 1. Rather than returning the correction factor to the initial value, it is possible to store in memory the final value of the factor and to start the next pulldown with the stored value. It is also possible to store in memory an intermediate value between the final value and the initial value (average value, or initial value+(final value−initial value) * coefficient where 0<coefficient<1) and start the next pulldown from the stored value.

Figure 15:
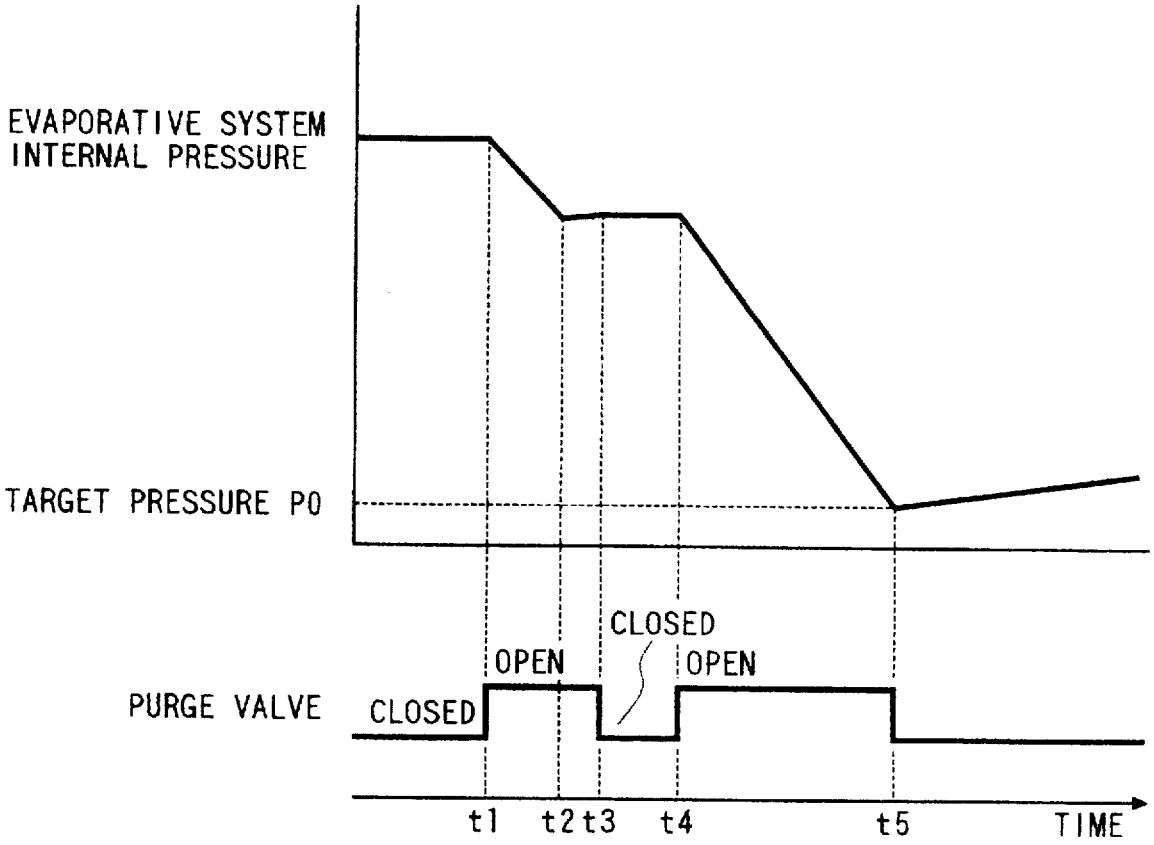
FIG. 15 is a diagram showing a case where the pulldown is stopped during the process.

Next, a process of stopping the pulldown when the amount of change of the internal pressure Pt in the evaporative system being pulled down is smaller than a predetermined value (which means that the negative pressure hardly increases or it decreases because the direction of growing negative pressure is taken as positive) will be explained by referring to FIG. 15. At time t1, the purge valve is opened to start the pulldown. Then, when during acceleration the negative pressure in the intake manifold becomes small or when the pulldown does not proceed (pressure stops decreasing) from time t2 due to rapid evaporation of fuel from the fuel tank, the control unit determines at time t3 that the change in Pt becomes smaller than the predetermined value and closes the purge valve. A predetermined time later at time t4, the purge valve is opened again to resume the pulldown. At this time, if the change of Pt is smaller than the predetermined value, the purge valve is closed again. The timing for opening the purge valve after it was closed may be determined by clocking a predetermined length of time or detecting the condition that the negative pressure in the intake manifold becomes greater than a predetermined value.

Figure 16:
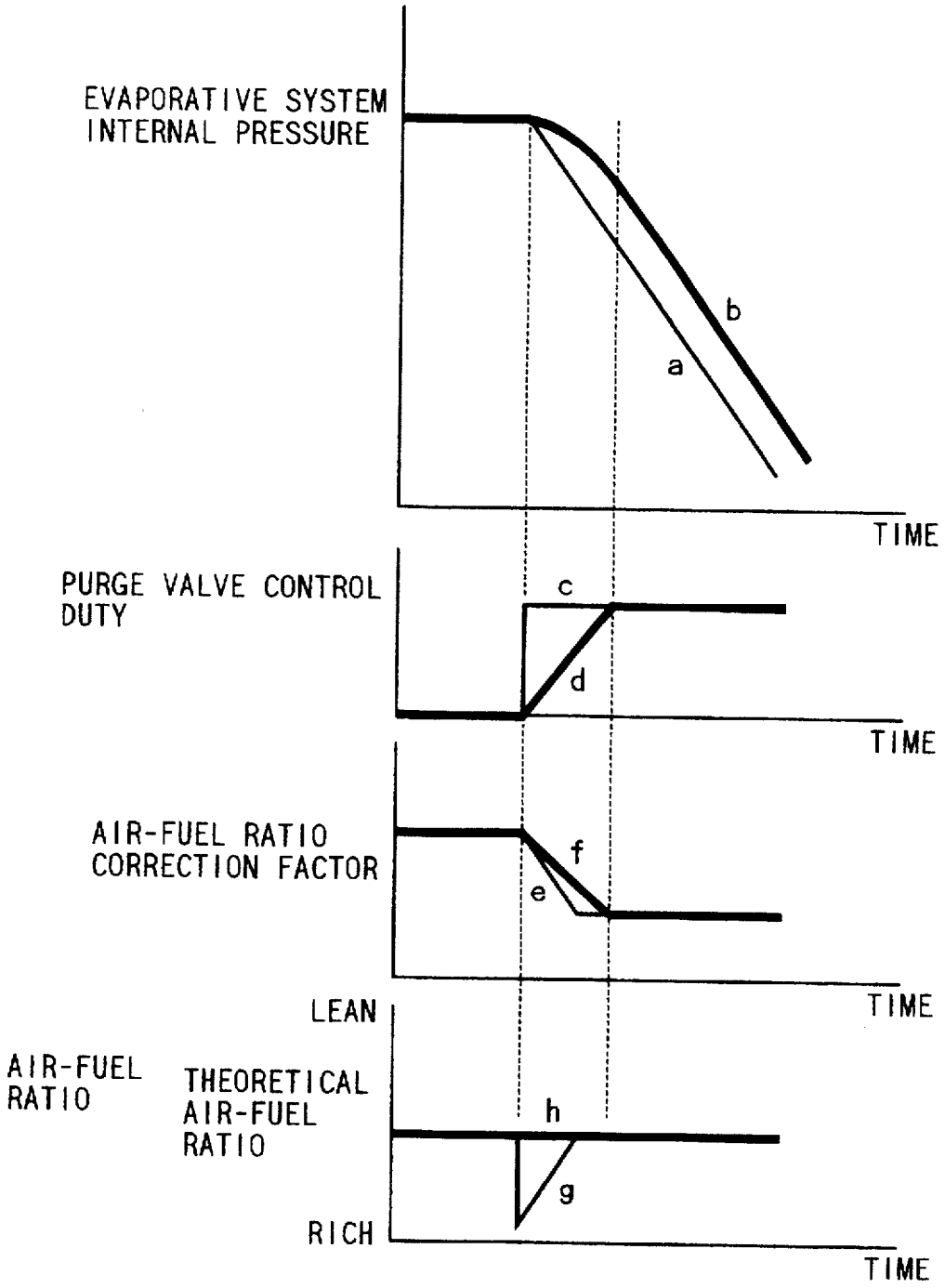
FIG. 16 is a diagram showing an example control performed at the start of the pulldown.

FIG. 16 shows a method of slowly opening the purge valve at the start of the pulldown and the effect of this method. When the purge valve is opened to a predetermined opening in a short time as indicated by a curve c, the internal pressure Pt in the evaporative system will be as shown by the curve a. Further, because the evaporative gas in the evaporative system rushes into the intake manifold, the air-fuel ratio correction factor is subjected to a lean correction as indicated by a curve e. However, the speed of this correction may not be fast enough and, in that case, the air-fuel ratio deviates from the theoretical air-fuel ratio and becomes rich, though temporarily, as shown by a curve g. As a result, hydrocarbon and carbon monoxide are released into atmosphere without being cleaned by catalyst. When on the other hand the purge valve is opened slowly as indicated by a curve d, the air-fuel ratio correction factor follows this curve, as indicated by a curve f, making it easy to correct the air-fuel ratio. The air-fuel ratio therefore hardly deviates from the theoretical air-fuel ratio as shown by a line h.

Figure 17:
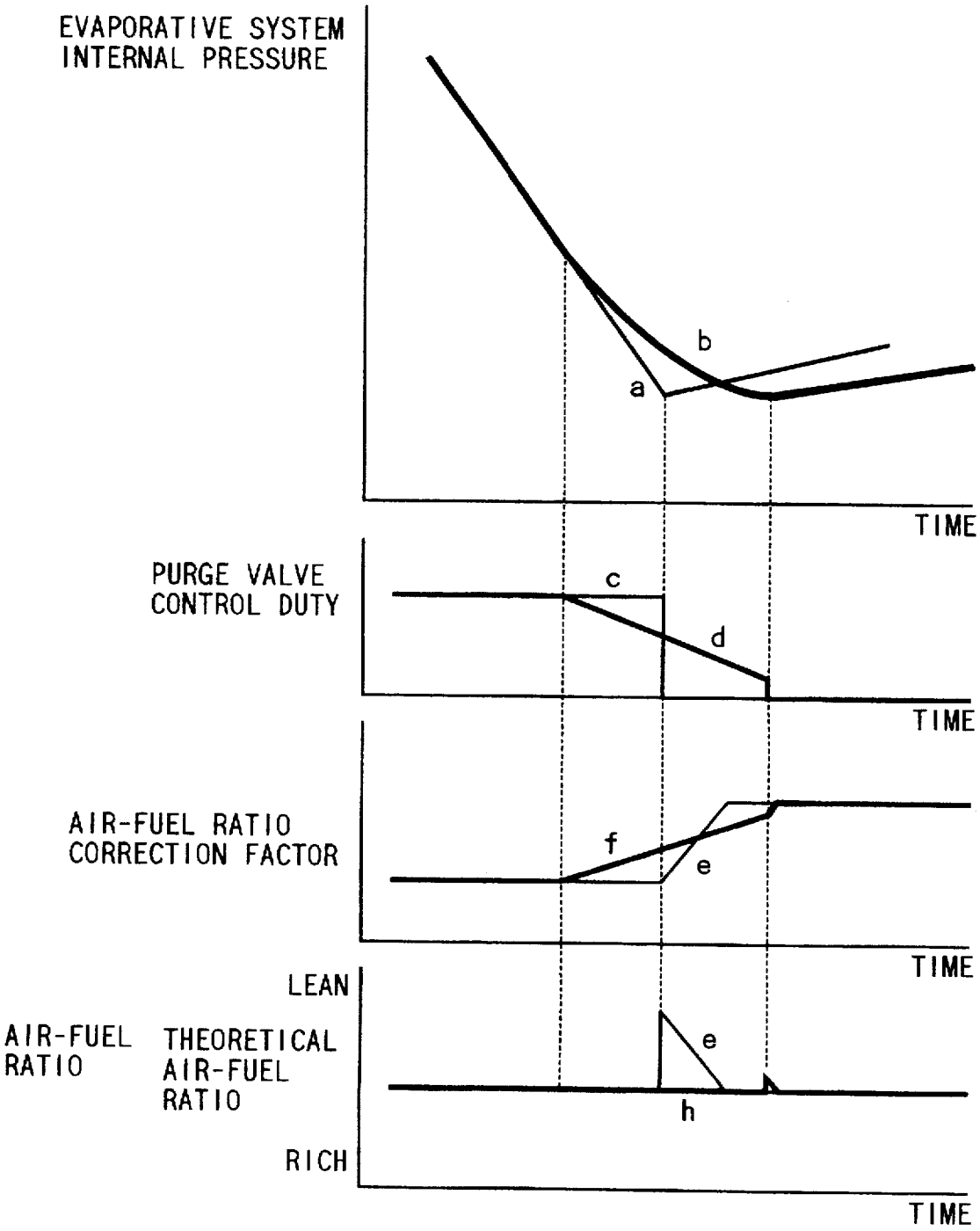
FIG. 17 is a diagram showing an effect of the soft landing.

FIG. 17 shows a method of slowly closing the purge valve at the end of the pulldown and the effects of this method. When the purge valve is closed from a predetermined opening to a fully closed position in a short time as shown by a curve c, the internal pressure Pt of the evaporative system will be as shown by a curve a. Because the evaporative gas in the evaporative system that is being introduced into the intake manifold is suddenly stopped, the air-fuel ratio correction factor is subjected to a rich correction (the correction factor is normally set to a lean correction while the evaporative gas is introduced; the factor in this case is changed to the direction of no-correction direction) as shown by a curve e. This correction may not be completed in time and, in that case, the air-fuel ratio deviates from the theoretical air-fuel ratio and becomes lean, though temporarily, as shown by a curve g. As a result, combustion becomes unstable causing variations in revolution and lowering the drivability. In the worst case, misfiring may result emitting hydrocarbons into atmosphere without cleaning them with catalyst. When on the other hand the purge valve is opened slowly as indicated by a curve d, the air-fuel ratio correction factor follows the opening action of the valve, as shown by a curve f, making it easy to correct the air-fuel ratio. The air-fuel ratio therefore hardly deviates from the theoretical air-fuel ratio as shown by a line h.

Figure 18:
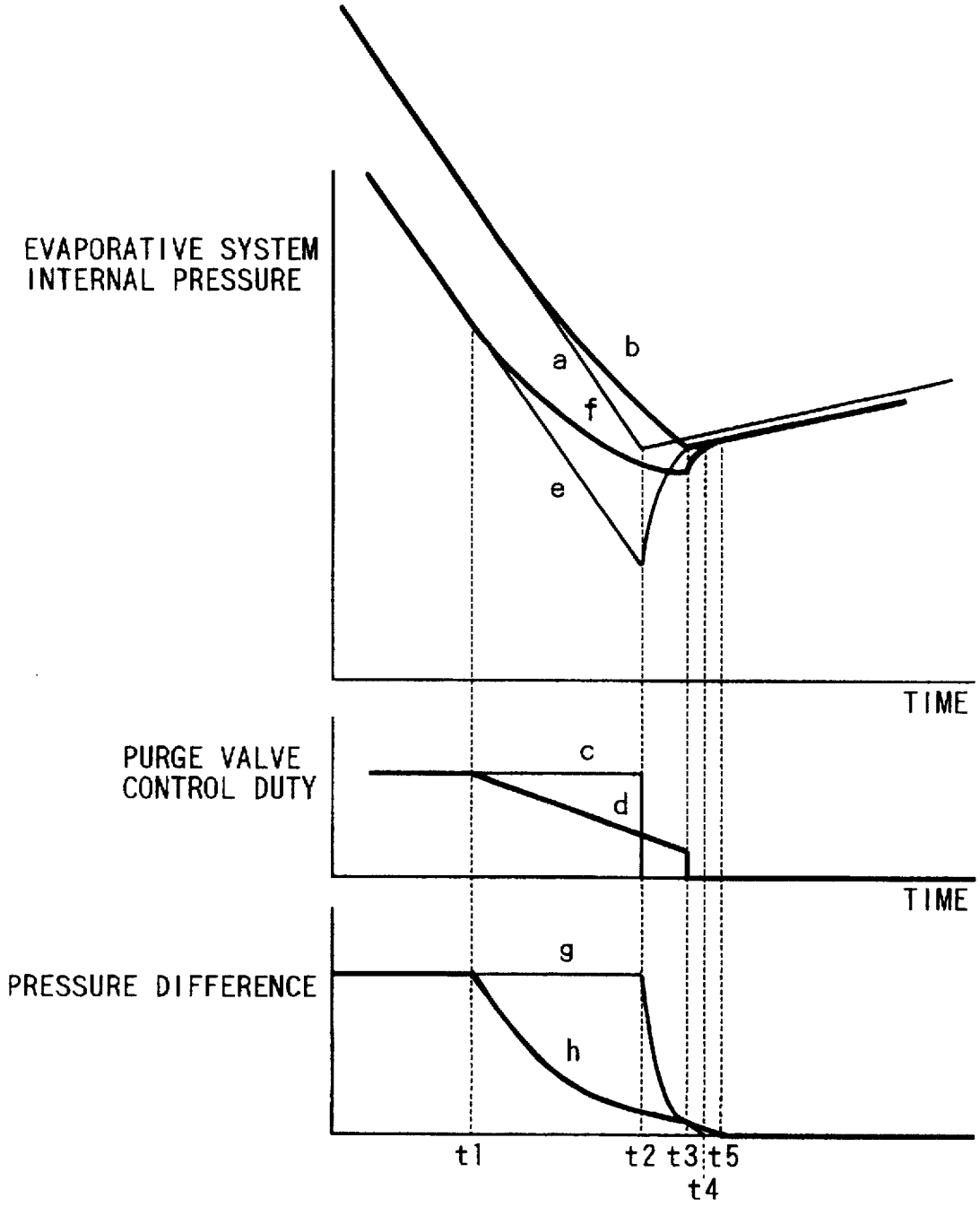
FIG. 18 is a diagram showing another effect of the soft landing.

FIG. 18 shows another effect obtained when the purge valve is slowly closed at the end of the pulldown. The lines a, b represent the internal pressures of the evaporative system measured near the fuel tank. The lines e, f represent the evaporative system internal pressures measured near the canister. There is correspondence between line a and line e and between line b and line f in the sense that the two associated lines were measured at the same time. The reason that the measured pressures vary depending on the measuring locations is that they are influenced by reductions in dynamic pressure due to pressure losses and gas flow in the piping. Now, let us consider a case where the pressure near the canister is used as the evaporative system internal pressure. When the purge valve is closed from a predetermined opening to a full-closed position in a short time as indicated by a curve c, the evaporative system internal pressure will change as shown by curves, a, e. Ideally, although the evaporative system internal pressure should adopt the curve a, which is the pressure in the tank, this method will take 1–5 seconds from the time t2 when the purge valve is closed to the time t4 when the curve a and the curve e agree. Hence, the measurement of pressure for the leakage detection needs to wait this period. If a heavy leakage actually exists, the evaporative system internal pressure becomes small during this waiting time, degrading diagnostic precision. The pressure difference between line a and line e is represented by a line g. The pressure difference when the purge valve is closed (t2) is as great as about 5–10 mmHg and it is thus necessary to set the target pulldown pressure P0 greater than the desired pulldown pressure by the amount of this pressure difference. When on the other hand the purge valve is closed gradually as indicated by the line d, the internal pressure of the evaporative system will be as shown by the curves b, f, shortening the time taken from the moment that the purge valve was closed to the moment the curves b and f agree, and also reducing the pressure difference when the purge valve is closed.

What is claimed is:

1. In a method of diagnosing an evaporative system according to an internal pressure of the evaporative system, which absorbs an evaporative gas generated in a fuel tank into an absorber and releases the absorbed evaporative gas into an intake manifold of an engine, the evaporative system diagnosing method comprising:

a pulldown process for making an internal pressure of the evaporative system a negative pressure;

wherein a pulldown rate in the pulldown process is changed according to the internal pressure of the evaporative system or a pressure change in the internal pressure of the evaporative system;

wherein when the change in the internal pressure of the evaporative system being pulled down becomes smaller than a predetermined value, the pulldown process is interrupted or stopped.

2. In a method of diagnosing an evaporative system according to an internal pressure of the evaporative system, which absorbs an evaporative gas generated in a fuel tank into an absorber and releases the absorbed evaporative gas into an intake manifold of an engine, the evaporative system diagnosing method comprising:

a pulldown process for making an internal pressure of the evaporative system a negative pressure;

wherein a pulldown rate in the pulldown process is changed according to the internal pressure of the evaporative system or a pressure change in the internal pressure of the evaporative system;

wherein a maximum required time from the start to the end of the pulldown process is determined beforehand.

3. In a method of diagnosing an evaporative system which absorbs an evaporative gas generated in a fuel tank into an absorber and releases the absorbed evaporative gas into an intake manifold of an engine, the evaporative system diagnosing method comprising:

a pulldown process for making a pressure of the evaporative system a negative pressure;

wherein a pulldown rate in the pulldown process is changed according to the internal pressure of the evaporative system or a pressure change in the internal pressure of the evaporative system.

4. An evaporative system diagnosing method according to claim 3, wherein the pulldown rate is changed according to a difference between a target pulldown pressure and the internal pressure of the evaporative system being pulled down.

5. An evaporative system diagnosing method according to claim 3, wherein the pulldown rate is changed according to a difference between a reference pressure based on a predetermined pulldown rate pattern and the actual internal pressure of the evaporative system being pulled down.

6. An evaporative system diagnosing method according to claim 3, wherein the pulldown rate is changed according to a difference between an amount or rate of change of the actual internal pressure of the evaporative system being pulled down and a predetermined target amount or rate of change.

7. An evaporative system diagnosing method according to claim 3, wherein in a predetermined period after the pulldown process is started, the pulldown is performed at a rate more moderate than in other parts of the pulldown process.

8. An evaporative system diagnosing method according to claim 3, wherein in a predetermined period before the pulldown process is ended, the pulldown is performed at a rate more moderate than in other parts of the pulldown process.

9. An evaporative system diagnosing method according to claim 3, wherein in a predetermined period after the pulldown process is started and in a predetermined period before the pulldown process is ended, the pulldown is performed at a rate more moderate than in other parts of the pulldown process.

10. An evaporative system diagnosing method according to claim 4, wherein the pulldown rate is increased as the difference between the target pulldown pressure and the internal pressure of the evaporative system being pulled down increases.

11. An evaporative system diagnosing method according to claim 5, wherein the pulldown rate is increased as the difference between the reference pressure given by the predetermined pulldown rate pattern and the actual internal pressure of the evaporative system increases.

12. An evaporative system diagnosing method according to claim 6, wherein the pulldown rate is increased as the difference between the amount or rate of change of the actual internal pressure of the evaporative system being pulled down and the predetermined target amount or rate of change increases.

* * * * *